US010201251B2

(12) United States Patent
Barrett

(10) Patent No.: US 10,201,251 B2
(45) Date of Patent: Feb. 12, 2019

(54) PORTABLE COLLAPSIBLE FREE-STANDING SHOWER

(71) Applicant: Scott E Barrett, Grover Beach, CA (US)

(72) Inventor: Scott E Barrett, Grover Beach, CA (US)

( * ) Notice: Subject to any disclaimer, the term of this patent is extended or adjusted under 35 U.S.C. 154(b) by 0 days.

(21) Appl. No.: 15/256,903

(22) Filed: Sep. 6, 2016

(65) Prior Publication Data

US 2018/0014698 A1 Jan. 18, 2018

Related U.S. Application Data

(63) Continuation of application No. 13/795,360, filed on Mar. 12, 2013, now abandoned.

(60) Provisional application No. 61/609,494, filed on Mar. 12, 2012.

(51) Int. Cl.
*A47K 3/32* (2006.01)
*E04H 1/12* (2006.01)

(52) U.S. Cl.
CPC ..... *A47K 3/325* (2013.01); *E04H 1/1266* (2013.01); *E04H 1/1244* (2013.01)

(58) Field of Classification Search
CPC ..... E04H 15/003; E04H 15/40; E04H 15/405; E04H 15/44; E04H 15/46; E04H 15/48; E04H 15/42; E04H 1/1277; A47K 3/285; A47K 3/286; A47K 3/32; A47K 3/325
USPC .... 4/599, 600, 602, 603, 900; 135/902, 905; 160/351, 377
See application file for complete search history.

(56) References Cited

U.S. PATENT DOCUMENTS 1,990,804 A * 2/1935 Watson ..... E04H 1/1244 135/128
2,142,851 A * 1/1939 Jolly ..... E04H 15/003 135/118
2,852,784 A * 9/1958 Winkler ..... A47K 3/325 4/599
3,657,746 A * 4/1972 Downey ..... A47K 3/325 4/599
3,681,788 A * 8/1972 Le Blanc ..... A47K 3/325 4/602

(Continued)

FOREIGN PATENT DOCUMENTS

CH 665763 A5 * 6/1988 ..... A47K 3/325

*Primary Examiner* — Erin Deery
(74) *Attorney, Agent, or Firm* — Guy Cumberbatch

(57) ABSTRACT

A portable shower includes an enclosure that converts between a two-dimensional collapsed configuration and a three-dimensional upright configuration defining a space therein for a person. The enclosure is self-extending and free-standing in the upright configuration, and desirably has a height of at least 4 feet. The enclosure includes a liner, preferably tubular in shape when extended, and an integrally attached collapsible skeleton such as an elastic coil, preferably helical. The elastic coil has a sufficient relaxed size and spring constant to self-expand the liner when constraints are released. A water reservoir connects to a shower sprayer through a hose, and may be integrated in the wall of the enclosure. For instance, a helical sleeve around the liner may constrain both the elastic coil and the hose. A foot pump may be provided along the hose and within the enclosure for easy propulsion of water from the reservoir to the sprayer.

22 Claims, 7 Drawing Sheets

(56) References Cited

U.S. PATENT DOCUMENTS

| | | | | | |
|---|---|---|---|---|---|
| 3,925,828 | A * | 12/1975 | Kim | A47K 3/325 | 135/157 |
| 4,761,908 | A * | 8/1988 | Hayes | A01M 31/025 | 43/1 |
| 5,430,980 | A * | 7/1995 | Ferrier | E04H 1/1244 | 135/126 |
| 5,564,660 | A * | 10/1996 | Gyor | B65B 67/12 | 248/97 |
| 5,628,338 | A * | 5/1997 | Stumbo | E04H 15/40 | 135/147 |
| 6,233,880 | B1 * | 5/2001 | Sogame | B64G 9/00 | 52/245 |
| 7,040,333 | B1 * | 5/2006 | Ransom | E04H 15/32 | 135/115 |
| 7,047,577 | B1 * | 5/2006 | Cirilli | A47K 3/325 | 4/599 |
| 7,946,307 | B2 * | 5/2011 | Zheng | E04H 15/40 | 135/126 |
| 9,758,986 | B1 * | 9/2017 | Moore | E04H 15/44 | |
| 9,932,752 | B1 * | 4/2018 | Vila | A45F 3/02 | |
| 2010/0086237 | A1 * | 4/2010 | Diepen | A45C 3/04 | 383/12 |
| 2015/0184378 | A1 * | 7/2015 | Silva | E04H 15/003 | 160/351 |

* cited by examiner

PORTABLE COLLAPSIBLE FREE-STANDING SHOWER

RELATED APPLICATIONS

The present application is a continuation of U.S. application Ser. No. 13/795,360, filed Mar. 12, 2013, which claims priority under 35 U.S.C. § 119 to U.S. Provisional Application Ser. No. 61/609,494, filed Mar. 12, 2012.

FIELD OF THE INVENTION

The present invention relates to a portable shower and, more particularly, to a portable shower having a collapsible enclosure that self-extends from a flat, portable shape to a free-standing configuration of at least 4 feet tall.

BACKGROUND OF THE INVENTION

Campers and other persons who spend time outdoors often have a need or a desire to bathe outdoors. The bathing process is greatly enhanced if the camper can bathe in privacy and has a support surface on which to stand other than bare ground. Solar shower bags are commercially available for outdoor bathing. A solar shower bag is a plastic bag which is capable of holding several gallons of water. Exposing the bag to solar radiation heats the water in the bag. However, the solar shower bag does not include any means to support the bag during use, a surface to stand on other than bare ground, or a privacy curtain.

There are numerous portable shower units for use for bathing and decontamination purposes. Most of the prior portable shower units include a single nozzle for dispensing a steady stream of water for bathing purposes. U.S. Pat. Nos. 2,852,784, 3,629,875, 3,925,828, and 4,413,363 are illustrative of portable prior art shower apparatuses having a single nozzle for dispensing a steady stream of water for bathing purposes. U.S. Pat. Nos. 1,065,265, 2,336,402 and 4,554,690 are illustrative of portable shower apparatuses having a plurality of nozzles for dispensing steady streams of water for bathing purposes.

These prior art shower units, while somewhat portable, have several drawbacks or disadvantages. The principal disadvantage of these prior art shower units resides in their rigid, non-collapsible, structure which precludes the ready and easy movement of the shower unit from one location to another. Even so-called collapsible shower units typically have a number of elongated struts that are connected together to form a frame, a process which is cumbersome.

There remains a need for a more elegant and easy-to-deploy portable shower.

SUMMARY OF THE INVENTION

The present application provides a portable pop up sprung shower enclosure.

A portable shower disclosed herein has a collapsible enclosure have a skeleton above a base adapted to collapse down to a generally two-dimensional configuration. The collapsible skeleton expands upward from the base to form an upstanding hollow shape around an inner space large enough for a person to stand in. The enclosure further includes a flexible liner attached to the skeleton so that when the skeleton expands the liner obscures a person within the inner space configuration. A flexible water hose connected to a sprayer attaches to the collapsible enclosure, the hose being incorporated into the enclosure so that it collapses and expands therewith. For instance, the hose may be secured to pockets sewn into the liner. In one embodiment the shower further includes a water reservoir connected to the hose to supply water through the hose to the sprayer, and a pump connected to the water hose in series between the reservoir and the sprayer. The liner is desirably biodegradable so that it can degrade under the sun in a month or so. The collapsible skeleton may define a longitudinal gap on one side, and the liner has a longitudinal opening therein large enough for ingress and egress of a person to and from the inner space. The collapsible skeleton may comprises a series of struts connected by junctions, the junctions being detachable from the struts, or it may be a coil of elastic material.

The shower enclosure provides privacy while changing/showering outdoors.

The shower enclosure also may be intended for the purpose of child's play and exploring the outdoors.

The shower enclosure is a stand-alone, self-contained, privacy enclosure. It will support its own weight by means of a spring that holds the structure erect vertical while retaining its shape at all times.

The privacy material that encapsulates the spring will not be transparent nor will it endanger the person or persons using this product.

The shower enclosure may be formed using a number of different components, including: a collapsible enclosure such as an off-the shelf garbage can to accommodate a person to change comfortably; rip stop tent fabric; water safe tube/hoses that will run the entire distance of the spring will be in the same sleeve as the spring and in another variation that is coiled much like a phone cord to rise and lower with the shower with a perforated hoop at the top of the shower will provide water to the person or persons cleansing; a foot syphon pump, and of an electric water pump that sends the water to the nozzle; a nozzle that is used to hose off the person; the base (floor) base of this may be made of light weight plastic or fabric that will be able to drain out the water through the floor; one water proof storage bag and one perforated bag to allow drainage; a solar water source/bag to siphon water from. The bag can be placed on the ground next to the shower, or suspended from above for gravity flow.

BRIEF DESCRIPTION OF THE DRAWINGS

Features and advantages of the present invention will become appreciated as the same become better understood with reference to the specification, claims, and appended drawings wherein:

FIG. 1B is a sectional view through a portion of the wall of the shower;

FIG. 2A is a partial view of an upper end of the exemplary portable shower illustrating one embodiment of an alternative sprayer.

DETAILED DESCRIPTION OF THE PREFERRED EMBODIMENTS

The present invention pertains to a free-standing, self-extending portable shower. The exemplary embodiment includes a shower enclosure that can be deployed from a generally two-dimensional portable configuration to a three-dimensional extended configuration by simply removing any constraints to extension. In the illustrated embodiment, the shower enclosure includes a generally tubular liner supported by a collapsible skeleton such as an integrally attached coil of elastic material. The tubular liner collapses to a generally circular two-dimensional shape and expense to a tubular shape surrounding an inner space of at least 4 feet tall. Though the tubular configuration of the shower enclosure is convenient and structurally simple, it should be understood that the horizontal cross-sectional shape may be other than circular, such as square or hexagonal, for instance. A tubular configuration permits the coil of elastic material to be formed in a helix, or in other words a large coil spring, which is efficient in terms of structural strength. However, the term "coil of elastic material" refers to helical as well as other shapes having corners, such as a hexagonal helix, for instance, and more generally the free-standing portable showers supported by a collapsible skeleton, as will be evident below.

Figure 1A:
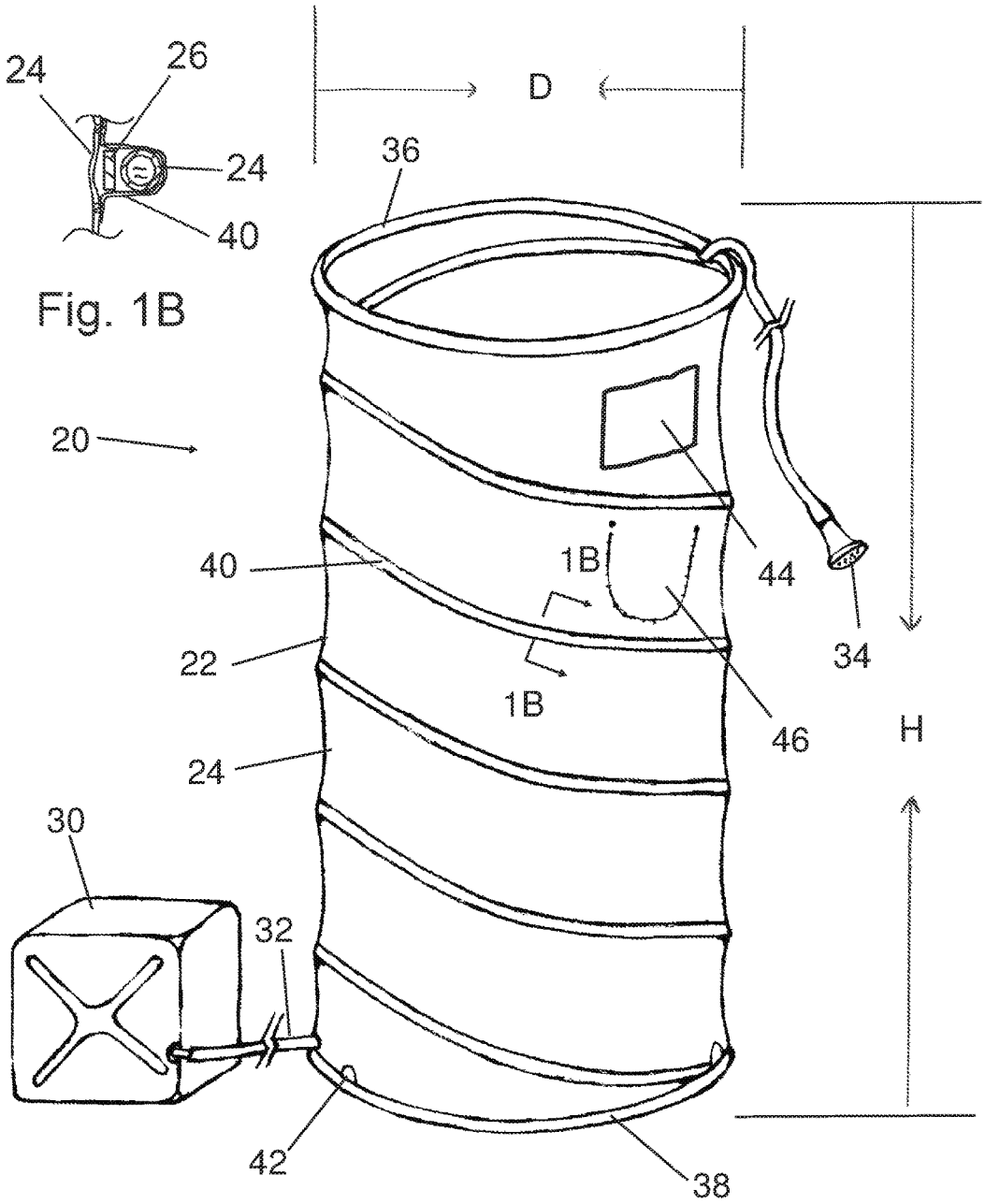
FIG. 1A is a perspective view of an exemplary portable shower of the present application in a deployed configuration showing a lower water reservoir connected through a hose to an upper sprayer.

FIGS. 1A and 1B illustrate a preferred embodiment of a portable shower 20 of the present application in a deployed configuration. As mentioned above, the exemplary shape of the portable shower 20 is tubular, though other shapes are possible utilizing be advantageous structural aspects described herein. The portable shower 20 includes a shower enclosure 22 formed by a flexible sheet-like liner 24 supported by a collapsible skeleton in the form of a coil 26 of elastic material, shown in the sectional view of FIG. 1B. A lower water reservoir 30 connects through a water hose 32 to an upper sprayer 34. The sprayer 34 can be any number of showerhead configurations, including an array of nozzles around a circular dispenser mounted above the enclosure 22 (shown in FIG. 2A) that provides a more rainfall like emission. Also not shown is a bracket that may be attached to an upper rim 36 of the enclosure and to which the sprayer 34 can be mounted for hands-free showering.

The hose 32 may be a simple plastic tube, or other similar expedient that is flexible enough to compress down from a helix to a flat coil. One possible configuration for the hose 32 is a mini FIRE HOSE such as sold under the "handi-hose" Trademark by American Specialty Manufacturing, Inc, located in Stoughton, Mass. Such a fabric-reinforced hose may work better because it compresses flat rather than retaining its tubular shape. Alternatively, simple polypropylene tubing can be used.

The shower enclosure 22 extends from the upper rim 36 to a lower rim 38. As seen in FIG. 1B, the elastic coil 26 resides within a sleeve or pocket formed by a strip of flexible material 40 sewn to the exterior of the liner 24. The flexible strip 40 forms a helical-shaped pocket around the enclosure 22 from the upper rim 36 to the lower rim 38. The elastic coil 26 is captured within the pocket formed by the flexible strip 40 and provides a skeleton or vertical structural support for the liner 24 to form the extended configuration of enclosure 22 as shown. In this regard, the elastic coil 26 preferably comprises a spring steel material having a spring constant sufficient to expand the liner 24 and other assembled components to a height of at least 4 feet. The following is a short list of potential suppliers of the spring steel: Ace Wire of Woodside, N.Y., Master Spring of River Grove, Ill., Automated Wire Products of Germantown, Wis., Jones Spring of Wilder, Ky., and Diamond Wire of Glenshaw, Pa.

In order to support the weight of the various assembled components of the extended shower 20, the fully extended elastic coil 26 has a height much greater than the extended height of the shower. For example, the fully extended elastic coil 26 may have an actual dimension of greater than twenty (20) feet. Those of skill in the art will understand the factors to take into account to select the proper elastic coil 26, and therefore further explanation is not required. In the illustrated configuration, the elastic coil 26 has a rectangular cross-section, as seen in FIG. 1B, with a greater vertical dimension than radial dimension. However, other coil configurations are possible. One possible construction is to incorporate characteristics of existing collapsible garbage cans or laundry hampers, the former available from Rubbermaid.

The shower enclosure 22 desirably includes a floor (not shown) surrounded by the lower rim 38 to prevent the user from getting dirty from standing on the ground. Small holes 42 are provided around the periphery of the enclosure just above the lower rim 38 for drainage.

One possible useful feature that could be included is a screen mesh window 44 located up to one quarter of the way down from the top of the enclosure 22; the window enabling the user to see out of the enclosure. As a privacy measure, an inner solid panel may be attached with Velcro to provide the ability to close the window. Also, about half-way down the enclosure 22, a zippered or Velcro door 46 may be added to enable the user to reach through and grab clothes to change without having to push the tube down to get them. The door 46 may be arc-shaped with a convex side down so that it naturally rests in its place when unzipped, occluding the aperture for privacy.

Various flexible materials for use as the liner 24 and flexible strip 40 are contemplated. For example, nylon, polypropylene, or other such polymer fabrics are preferred for their strength and light weight. Alternatively, treatments to make the fabric waterproof may be used, such as silicone impregnation or polyurethane coating. The thread that holds this all together may vary, however a polypropylene monofilament is a good choice.

The minimum height of 4 feet is set to provide an adequate enclosure 22 for the smallest in stature individuals, such as children. However, for adults, the enclosure 22 desirably has a vertical extended height H of anywhere between 5-7', and more particularly has a height of between about 5' 5" to 6' 2". The diameter D of the enclosure 22 may vary, but for personal use is preferably between about 35" to about 42". It will be understood that smaller showers for children or larger showers for groups of people could also be constructed using the principles described herein.

FIG. 1B also illustrates the water hose 32 captured within the pocket formed by the flexible strip 40. In the preferred embodiment, the water hose 32 extends in a helical configuration around the enclosure 22 along with the elastic coil 26. This configuration greatly simplifies the construction and minimizes the number of loose parts. Alternatively, the hose 32 may be routed outside of the enclosure 22 from the reservoir 30 to the sprayer 34. For example, instead of residing on the ground, the reservoir 30 may include a hook for attaching to a tree limb or other structure above the shower 20 with the hose 32 and sprayer 34 dangling downward therefrom, the water being expelled from the sprayer 34 by gravity. In another embodiment, the hose 32 connects to just the top end of the enclosure and has a coiled (phone cord) configuration to allow it to be stretched from a distance, or from the ground. Indeed, the assembly of the reservoir 30, hose 32, and sprayer 34 may not be integrated into the enclosure 22, and may be provided as separate components. Nevertheless, the exemplary configuration routes the hose 32 through the pocket formed by the flexible strip 40 along with the elastic coil 26. It should be noted that the strength of the elastic coil 26 must take into account the weight added by the water within the coiled hose 32.

Figure 2B:
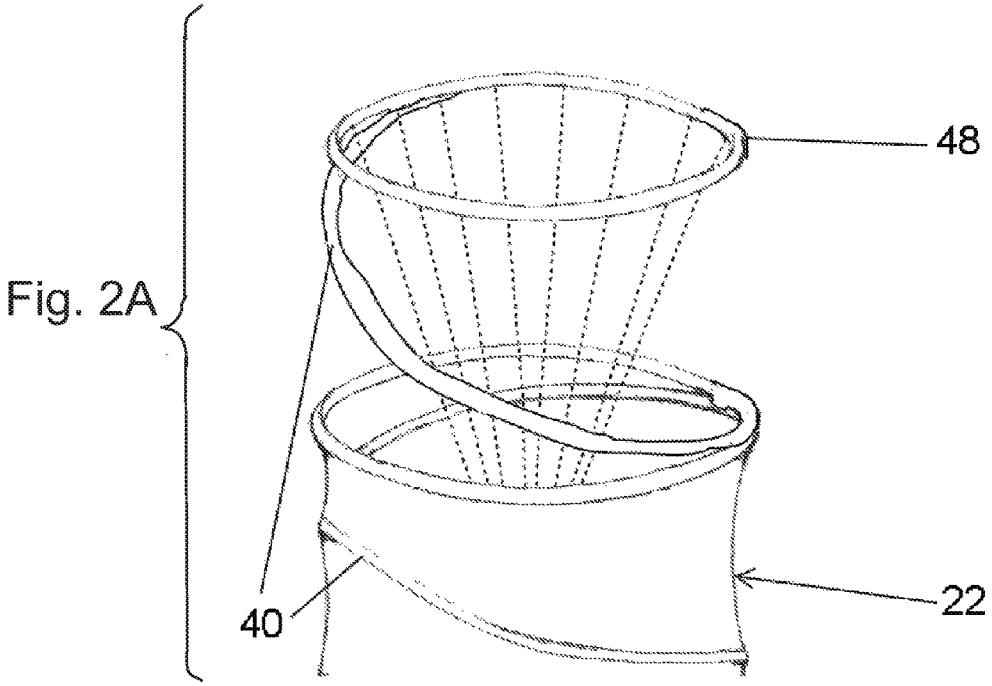
FIG. 2B is a partial view of a lower end of the exemplary portable shower with a portion of an outer enclosure cutaway to reveal a preferred configuration of pump used to propel water from the lower reservoir to the upper sprayer.

FIG. 2A shows an upper end of the exemplary portable shower 20 illustrating an alternative sprayer comprising an array of nozzles around a circular dispenser 48 mounted above the enclosure 22. The nozzles in the circular dispenser 48 may be simple holes positioned so that the aggregate spray of water is centered at the middle of the enclosure 22. The circular dispenser 48 may be a rigid plastic tube to which the hose 32 connects, and the elastic coil 26 and hose 32 may continue upward together above the enclosure 22 in a helix as shown to provide support for the circular dispenser 48. In this way, the circular dispenser 48 may be compressed down into the two-dimensional portable shape by simply compressing the coil 26 and hose 32. A tubular extension of the flexible strip 40 may be used to constrain the coil 26 and hose together along the final upper extent. Those of skill in the art will understand that there are numerous other ways to support a sprayer above the enclosure 22, and also other possible sprayer configurations.

Figure 2B:
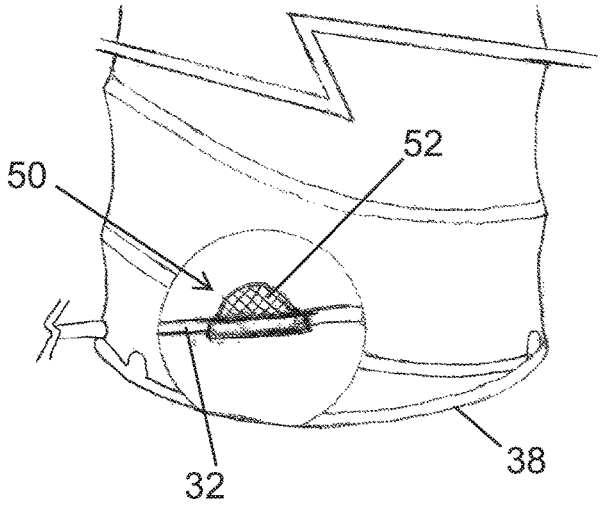
Figure 3C:
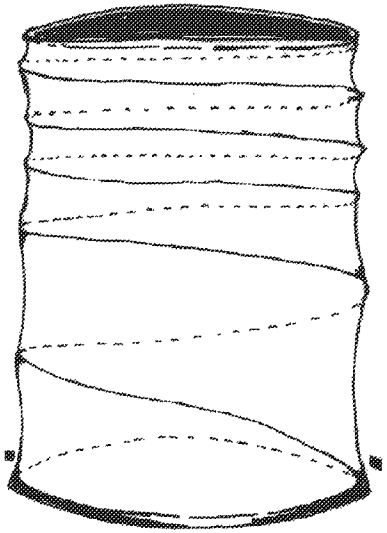
FIGS. 3A-3D are perspective views of an exemplary outer enclosure of the portable shower of the present application being collapsed from a three-dimensional extended configuration to a two-dimensional collapsed configuration.
Figure 3D:
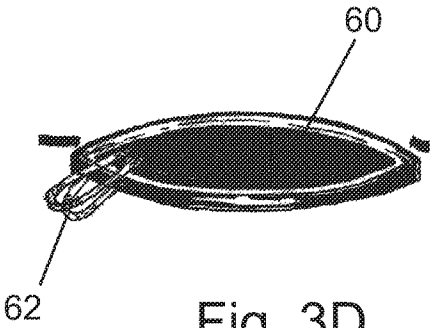
Figure 3B:
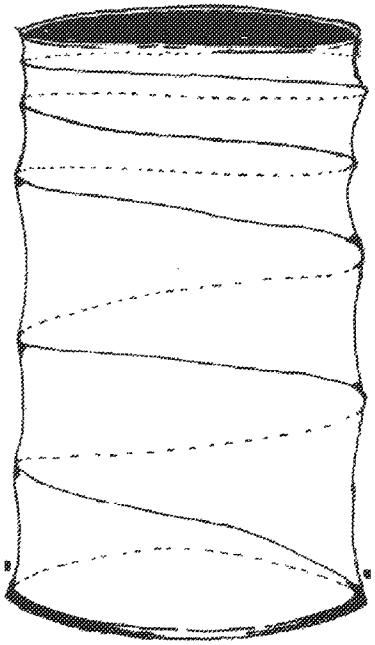
Figure 3A:
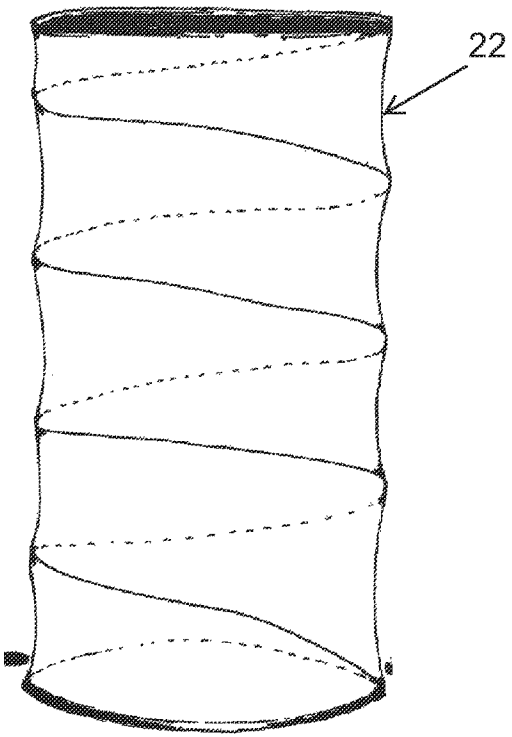

FIG. 2 illustrates the lower end of the exemplary portable shower 20 with a portion cutaway to reveal a preferred configuration of foot pump 50 used to propel water from the lower reservoir 30 to the upper sprayer 34. The foot pump 50 includes two one-way valves (not shown) and a resilient bladder 52 that permits the user to propel water through the hose 32 by repeatedly stepping on the pump. Such pumps are commonly used for siphon purposes. This configuration is relatively inexpensive and does not add significantly to the collapsed size or weight. In other embodiments, a pressurized water pumping system or even electric pump may be provided, though such accoutrements add cost and weight.

FIGS. 3A-3D are perspective views of the exemplary outer enclosure 22 being collapsed from a three-dimensional extended configuration to a two-dimensional collapsed configuration. Because of the relatively large diameter of the elastic coil 26, the enclosure 22 is easily collapsed from a height of around 6 feet to the two-dimensional configuration of FIG. 3D, which shows a carrying bag 60 having handles 62. The reservoir 30 is also desirably collapsible when empty and can be pressed flat and fitted within the carrying bag 60. Desirably, a draw string top (not shown) is provided to enclose wet garments securely within the enclosure 22 when in the closed position. The total weight of the assembly of components that form the exemplary portable shower 20 as seen in FIG. 1B is between around 4-7 lbs.

One beneficial application for the portable shower 20 disclosed herein is as a portable disposable chemical shower for HAZMAT (hazardous materials) spills. The shower 20 can be made extremely simply and economically to make it practical to dispose of after one use. In this regard, the various materials may be made from biodegradable plastics to help avoid landfill clutter. A chemical dilution liquid may be supplied in the reservoir 30 to provide a personal chemical shower, or each reservoir 30 may include a fill nozzle to enable filling at the spill site.

As mentioned above, the portable showers disclosed herein each have an enclosure such as a liner supported by a collapsible skeleton, which can be an elastic coil as indicated above or a series of separate elements connected together at junctions. An elastic coil is the simplest to deploy, although may require spring steel material which adds to expense and weight. A less elegant solution, but one which may be made lighter and less expensive is a series of separate plastic or fiberglass struts that are arranged in a pseudo-helical configuration and connected by junctions, as will be described below.

Figure 4B:
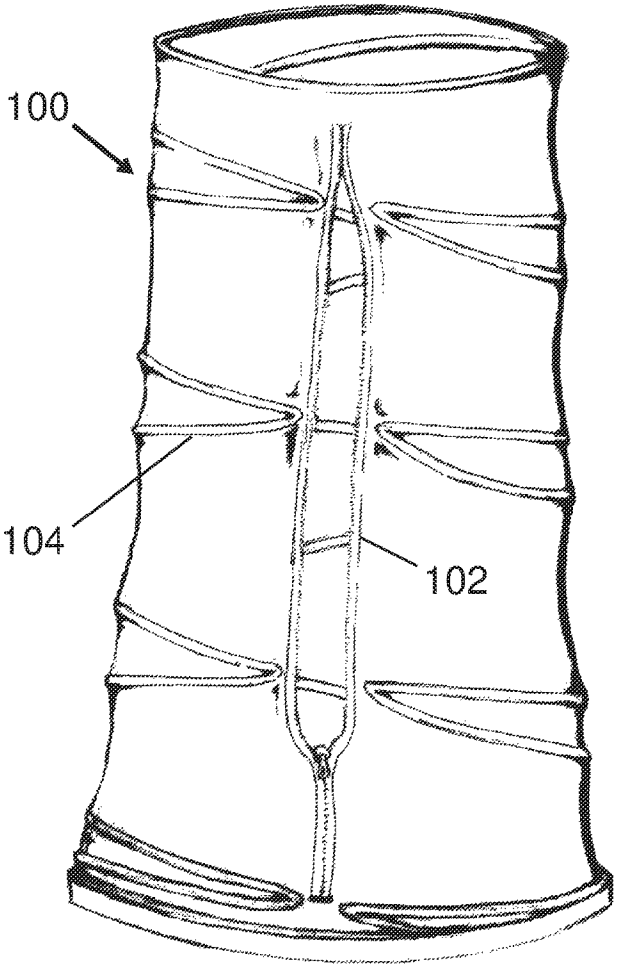
FIGS. 4A and 4B are elevational views of an alternative enclosure portion of the portable shower having a collapsible skeleton that is discontinuous around the circumference of the enclosure to accommodate a longitudinal zipped opening for ingress and egress.
Figure 4A:
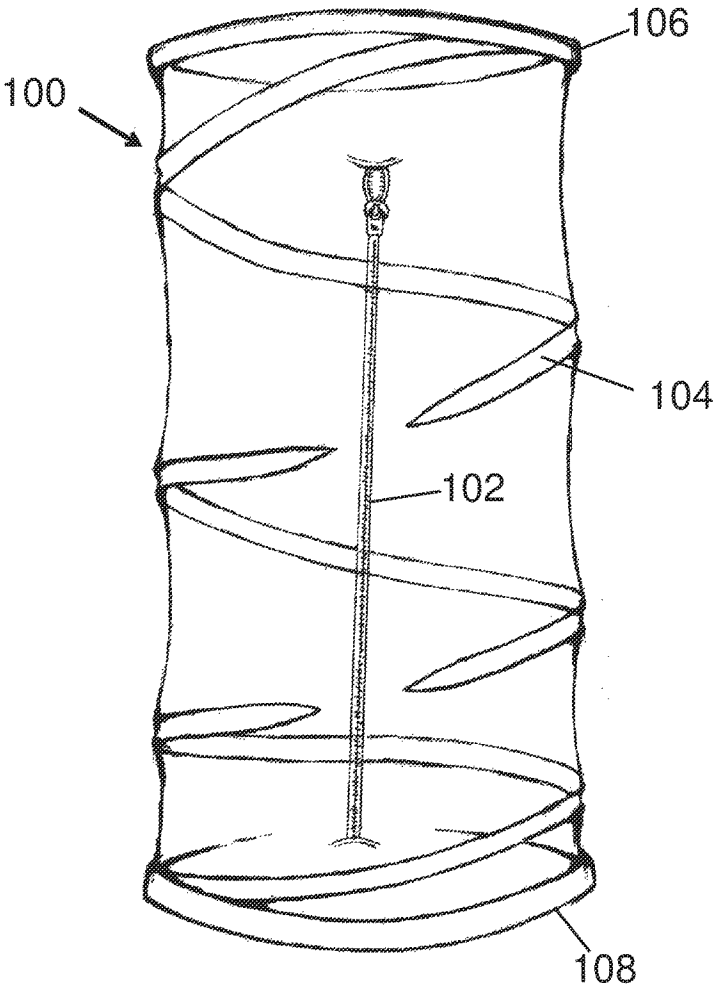

FIGS. 4A and 4B illustrate an alternative enclosure 100 of a portable shower (with the aforementioned fluid supply and showerhead removed) having a collapsible skeleton (not shown) that is discontinuous around the circumference of the enclosure to accommodate a longitudinal zipped opening 102 for ingress and egress. Several collapsible skeletons which may be utilized so as to provide a vertical discontinuity on one side and enable the longitudinal opening 102 are described below. FIGS. 4A and 4B merely indicate pockets 104, stitching, or the general orientation of internal skeletons visible from the exterior of the enclosure 100. The longitudinal opening 102 extends from a point just below the upper end 106 of the enclosure to a point above the lower end 108. As described above, the enclosure 102 preferably has circular rings of structural material at the upper and lower ends 106, 108, through which the opening 102 does not extend. The opening 102 may have a zippered closure, as shown, or Velcro flaps, buttons, ties, etc., which enable quick separation and closure.

Figure 5B:
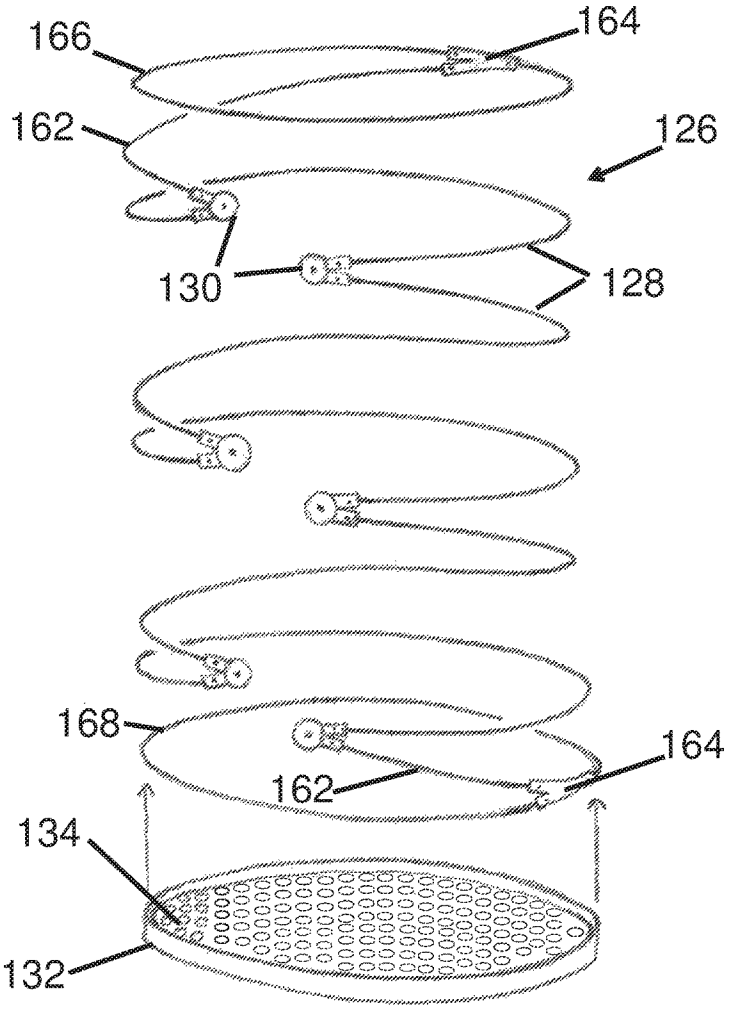
FIG. 5B is an elevational view of just the collapsible skeleton above a base plate having drainage holes.
Figure 5A:
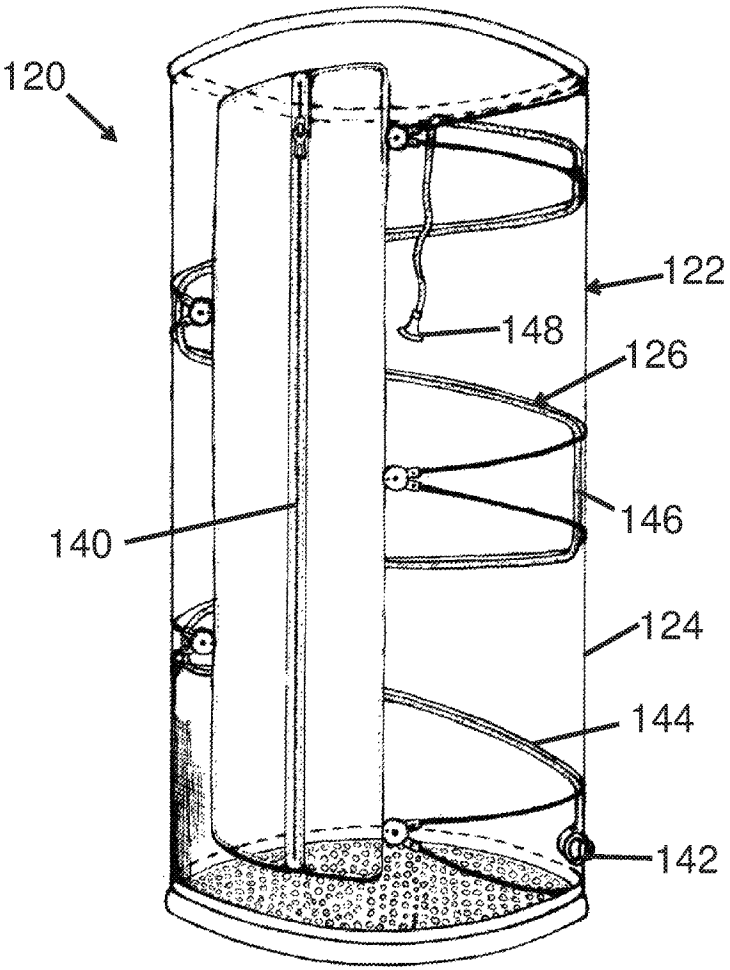
FIG. 5A is an elevational view of alternative portable shower having an enclosure portion with a liner shown transparent to illustrate an inner collapsible skeleton formed of the plurality of struts connected by disc-shaped junctions.

FIG. 5A illustrates another portable shower 120 having an enclosure 122 defined by a liner 124 and an inner collapsible skeleton 126. The liner 124 is transparent to expose the skeleton 126, which is formed of a plurality of struts 128 connected by disc-shaped junctions 130, shown in more detail below. FIG. 5B is an elevational view of just the skeleton 126 above a base plate 132 having drainage holes 134.

The collapsible skeleton 126 is discontinuous defining a longitudinal gap that permits the provision of an opening 140 having a zippered closure, as illustrated. As seen best in FIG. 5B, the skeleton 126 comprises a series of generally helically-shaped struts 128 that extend nearly the entire circumference of the enclosure 122, such as between about 270-315°. The flexibility of the skeleton 126 permits the longitudinal gap provided thereby to be made relatively narrow, such that a person can enter and exit the enclosure 122 through the opening 140 by flexing the skeleton.

The portable shower 120 further includes a nozzle 142 at a lower end that provides a water inlet for a supply tube 144 that snakes upward along the liner 124 partly adjacent to the skeleton 126. To avoid sharp bends in the tube 144, and kinking, vertical shortcuts 146 are provided that avoid the sharp V-shaped portions that terminated the junctions 130. As before, the tube 144 may be held within fabric pockets or sleeves sewn into the interior or exterior of the liner 122. At an upper end of the enclosure 122, the supply tube 144 terminates in a showerhead 148 which may hang loose, as indicated, for hand-held showering, or may be supported by a vertical frame that extends upward from the enclosure (not shown).

Figure 6A:
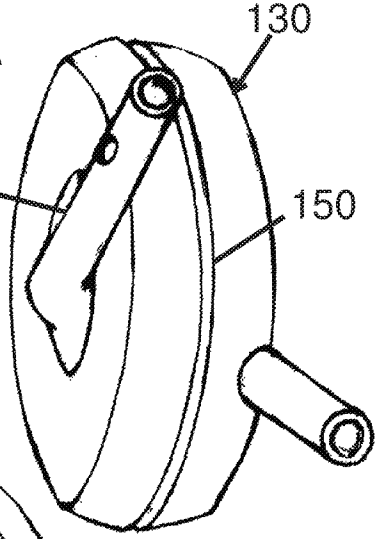
FIGS. 6A and 6B are perspective and elevational views of exemplary disc-shaped junctions for joining the struts of the skeleton of the portable shower in FIG. 5A.
Figure 6B:
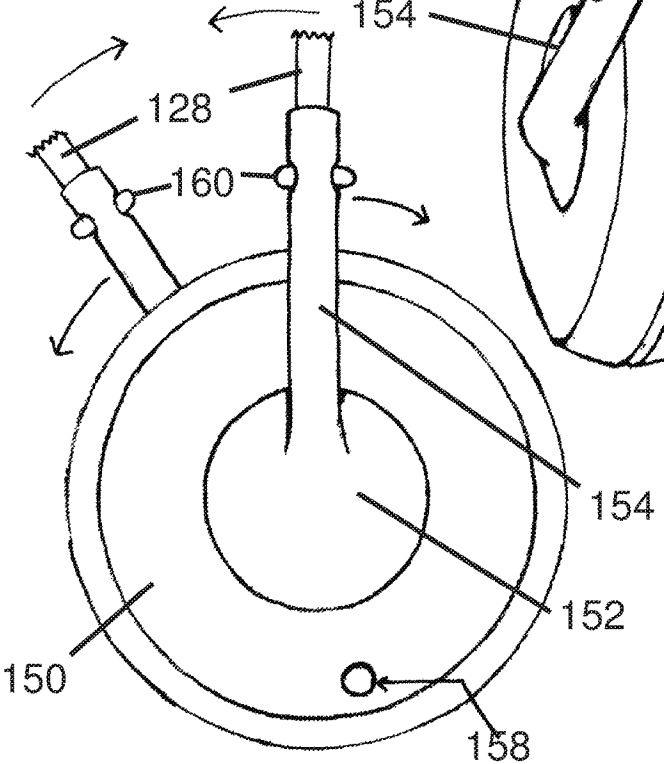

FIGS. 6A and 6B are perspective and elevational views of exemplary disc-shaped junctions 130 connecting the struts 128 of the skeleton 126 of the portable shower 120. Each of the junctions has a circular bearing member 150 opposite sides of which rotate hubs 152 having radially-projecting tubes 154. The hubs 152 and tubes 154 may rotate freely relative to the bearing member 150, though their relative positions may be locked into the V-shaped orientation shown using a spring-loaded lock pin 158. The internal mechanism of the junctions 130 that enables the tubes 154 to be locked into the orientation shown will not be further described, and may be any number of configurations.

Figure 9:
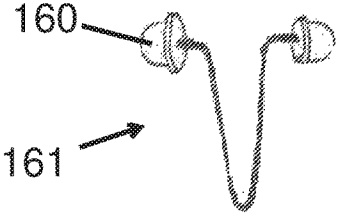
FIG. 9 is an isolated view of a V-shaped spring member for use to couple collapsible skeleton struts and junctions.

Each of the radially-projecting tubes 154 receives a free end of one of the struts 128 of the collapsible skeleton 126. Spring-loaded locking pins 160 fixed with respect to the struts 128 are pop outward through openings in the tubes 154 to hold the struts therein. The engagement between the struts 128 and tubes 154 is similar to that which allows height adjustment of crutches. For instance, small V-shaped springs 161 shown in FIG. 9 may be positioned within through bores of the tubular struts 128 such that locking pins 160 extend outward through apertures therein. The outer diameter of the struts 128 closely matches the inner diameter of the tubes 154, such that there is a close sliding fit and the locking pins 160 project outward through the apertures in the struts 120 and also through the apertures in the tubes 154.

Figure 7:
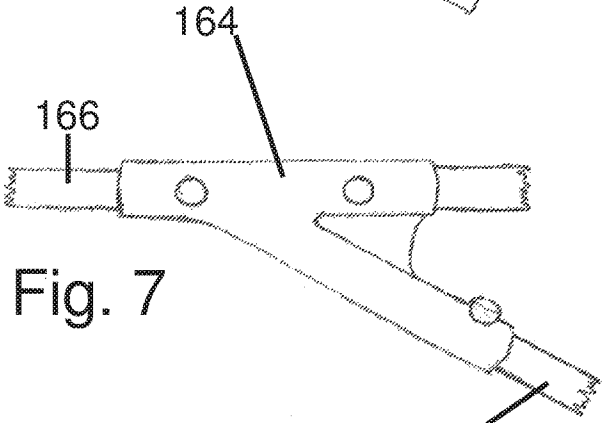
FIG. 7 is a Y-shaped junction for use in joining the individual struts of the collapsible skeletons of the portable showers disclosed herein.

With reference back to FIG. 5B, a series of the helically-shaped struts 128 are connected together with the disc-shaped junctions 130 to form the assembled skeleton 126. In the illustrated embodiment, there are five total struts 128 and six junctions 130. At the top and bottom of the skeleton 126, shorter struts 162 couple the outermost junctions 130 to a Y-shaped junction 164 (FIG. 7) that forms a part of an upper ring 166 or lower ring 168. The engagement between the shorter struts 162 and the Y-shaped junctions 164 is as described with respect to the disc-shaped junctions 130.

Preferably, each of the struts 128, 162 and upper and lower rings 166, 168 are held within pockets or sleeves sewn to the liner 122, but the disc-shaped junctions 130 are exposed. To collapse the skeleton 126, the user depresses the lock pins 158 on each of the junctions 130 so as to allow the tubes 154 to come together in substantial alignment, thus allowing the struts 128 to collapse from their own inherent flexibility. Conversely, when expanding the portable shower 120, the user depresses the lock pins 158 and one-by-one from the bottom up orients the tubes 154 of each junction 130 into the V-shapes such that the ends of the struts 128 are angled with respect one another. The inherent elasticity of each of the struts 128 forms a portion of the overall skeleton 126. In this sense, the skeleton 126 is a segmented coil of elastic material. However, because of the relatively shorter length of the struts 128 they do not need to expand the full height of the skeleton 126 and thus do not need to be formed of spring steel. Each strut 128 has sufficient stiffness to hold up a segment of the skeleton 126 with the help of the junctions 130, 164. It should be noted that a similar arrangement could be used to form a continuous helical coil made of the plurality of struts that continue around the enclosure, without the longitudinal gap and longitudinal opening 140.

Figure 8:
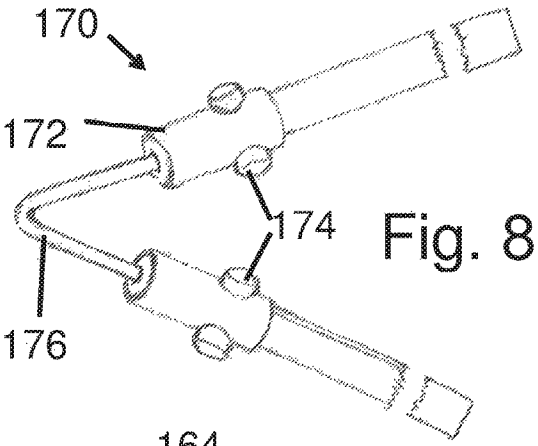
FIG. 8 illustrates an alternative V-shaped junction for use in joining the individual struts of the collapsible skeletons of the portable showers disclosed herein.

FIG. 8 illustrates an alternative V-shaped junction 170 for joining the individual struts 128. The junction 170 includes short tubular sleeves 172 having apertures for receiving spring-loaded buttons 174 held within the through bores of the struts 128. The sleeves 172 are joined by a V-shaped spring 176, made of spring metal or the like.

Figure 10:
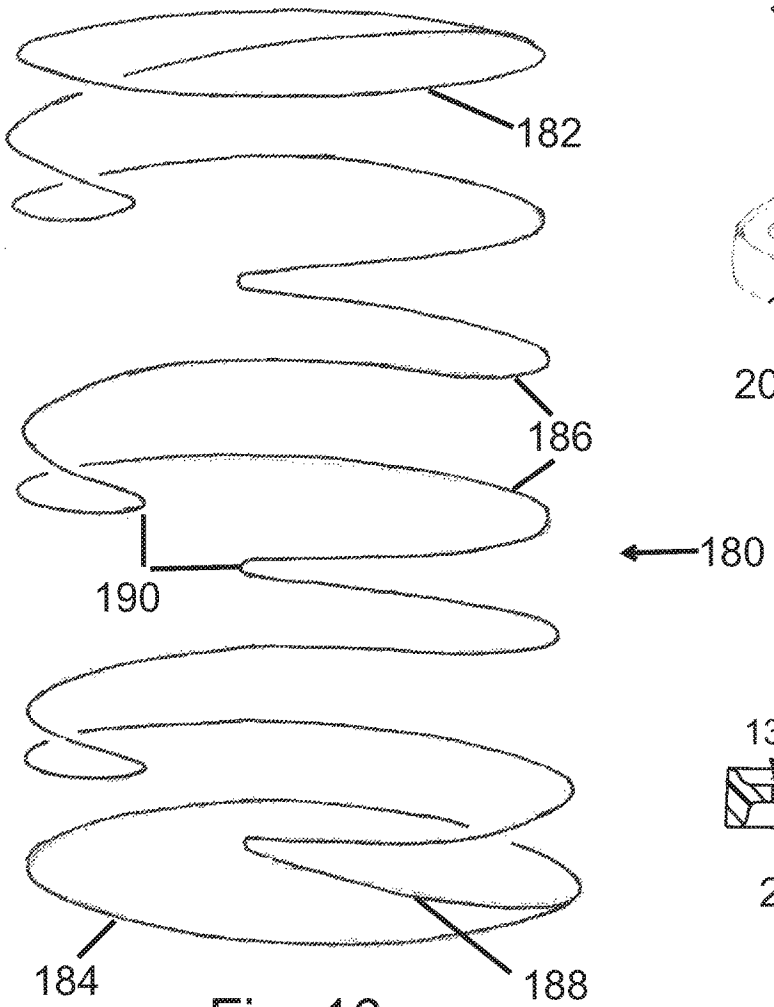
FIG. 10 is an elevation of view of an exemplary unitary collapsible skeleton for use with the portable shower enclosures having longitudinal openings.

FIG. 10 shows an exemplary unitary elastic collapsible skeleton 180 for use with the portable shower enclosures having longitudinal openings, described above. The skeleton 180 may be formed of spring metal, and include upper 182 and lower 184 hoops connected by a series of struts—elongated middle struts 186 and two shorter end struts 188. The middle struts 186 connect to each other and to the shorter struts 188 at V-shaped bends 190 in the metal, and extend around the majority of the circumference of the skeleton 180, such as described above. The shorter end struts 188 extend approximately halfway around the circumference of the skeleton 180. The V-shaped bends 190 are staggered axially and separated across a longitudinal gap. The gap allows an opening to be formed in the liner that, with the skeleton 180, creates the enclosure, such as the opening 102 in FIGS. 4A and 4B. It should be understood that any of the various skeletons can be used with any of the other liners and shower accessories as described herein.

Figure 11:
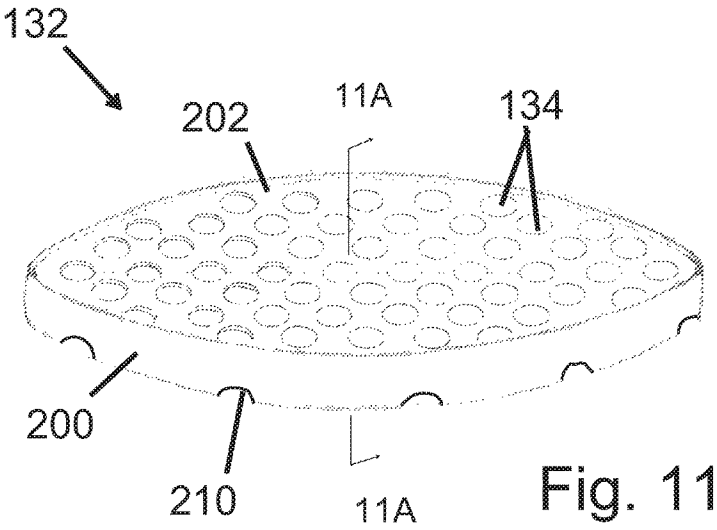
FIGS. 11 and 11A are perspective and diametric sectional views through an exemplary base plate having drainage holes.
Figure 11A:
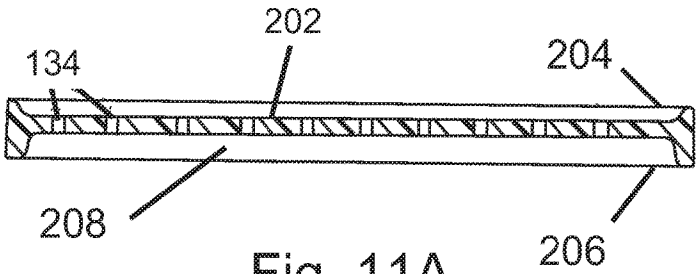

FIGS. 11 and 11A are perspective and diametric sectional views through an exemplary base plate 132 having drainage holes 134, such as shown in FIGS. 5A and 5B. The base plate 132 may be molded of a suitable lightweight polymer for rigidity. The base plate 132 may be sewn, adhered, or heat bonded to the upstanding liner, for example. In a preferred embodiment, the plate 132 includes a peripheral rim 200 and a perforated floor 202 through which the drainage holes 134 extend. The floor 202 is thinner than the height of the rim 200, so that the rim forms a surrounding upper lip 204 and a lower lip 206. The lower lip 206 raises the floor 202 up above the ground upon which the portable shower stands, such that water passes through the drainage holes 134 and into a space 208 below the floor. One or more gutter holes 210 may be provided in the lower edge of the rim 200 to prevent the water from becoming trapped below the floor 202.

The portable showers described herein are particularly useful for use in HAZMAT cleanups. In such situations, technicians don disposable coveralls to protect themselves against caustic chemicals, for example. After the job is complete, the technicians wearing the coveralls are sprayed off while standing in special runoff basin. Because the shower and is typically done without any special enclosure, there must be a fairly large area so that the runoff is caught in the basin. The portable showers disclosed herein may be used for such purpose, and placed within a smaller basin, or other such device for capturing the water that runs out of the bottom of the shower.

In a preferred embodiment, most if not all of the materials used for the portable showers described herein are biodegradable. After use, such as in the HAZMAT situation, the materials are stored in a safe location exposed to sunlight so that the materials degrade. For example, everything but the collapsible skeleton and the base plate (i.e., the liner and shower hose materials) are formed of UV-sensitive polymer which degrades within a month. This greatly facilitates cleanup of the potentially toxic chemicals that remain on the liner. The collapsible skeleton and the base plate are more durable and may easily be sterilized, such as in steam, and reassembled in another portable shower.

While the invention has been described in its preferred embodiments, it is to be understood that the words which have been used are words of description and not of limitation. Therefore, changes may be made within the appended claims without departing from the true scope of the invention.

What is claimed is:

1. A portable shower, comprising:

a collapsible enclosure having a flexible liner and a collapsible skeleton of elastic material secured to the liner, the skeleton being secured to the liner so that, when permitted to elongate longitudinally, the skeleton supports the enclosure in a three-dimensional extended configuration with the liner surrounding an inner space large enough for a person to stand in with the enclosure having a height of at least 4 feet, and wherein the skeleton is configured to be compressed longitudinally to collapse the enclosure down to a longitudinally flat configuration for transport, the skeleton of elastic material being formed by a series of connected struts surrounding the inner space, each strut following a helical path when the skeleton elongates, the struts being discontinuous around a circumference of the skeleton so as to define a longitudinal gap on one side of the skeleton extending between an upper circular ring and a lower circular ring, and the liner has a longitudinal opening aligned with the longitudinal gap large enough for ingress and egress of the person to and from the inner space; and a flexible water hose connected to a sprayer and attached to the collapsible enclosure, the hose being incorporated into the enclosure so that it collapses and expands with the enclosure.

2. The portable shower of claim 1, wherein a total weight of the portable shower is between 4-7 lbs, and further including a flat circular carrying bag into which the collapsible enclosure can be fitted in its longitudinally flat configuration.

3. The portable shower of claim 1, wherein the hose is held within pockets sewn into the liner.

4. The portable shower of claim 1, wherein the skeleton and the water hose are both secured around the liner from a first, lower end to a second, upper end of the liner.

5. The portable shower of claim 1, wherein the liner opening includes a closure selected from the group consisting of a zipper, flaps with mating hook and loop fasteners, buttons, and ties.

6. The portable shower of claim 1, wherein the series of struts are connected by junctions, the junctions being detachable from the struts.

7. The portable shower of claim 1, further including a base plate with a floor raised above a surface upon which the portable shower stands and having a plurality of perforated drainage holes, the collapsible enclosure extending upward from the base plate, and wherein the base plate is molded of a polymer and has a peripheral rim around the floor with an upper lip rising above the floor and a lower lip, the lower lip extending down from the floor so as to raise the floor up above the surface upon which the portable shower stands, the lower lip having a plurality of gutter holes distributed around a lower edge to prevent the water that passes down through the plurality of drainage holes from becoming trapped below the floor.

8. A portable shower, comprising:

a collapsible enclosure having a flexible liner and a skeleton of elastic material secured to the liner, the skeleton being secured around the liner so that, when permitted to elongate longitudinally, the skeleton supports the enclosure in a three-dimensional extended configuration with the liner surrounding an inner space large enough for a person to stand in, and wherein the skeleton is configured to be compressed longitudinally to collapse the enclosure down to a longitudinally flat configuration for transport, the skeleton of elastic material being formed by a series of struts surrounding the inner space wherein adjacent struts form a V-shaped angle with respect to each other when in an extended configuration and are each connected by a junction, the junctions defining a discontinuity around a circumference of the skeleton so as to form a longitudinal gap on one side of the skeleton extending between an upper circular ring and a lower circular ring, and the liner has a longitudinal opening aligned with the longitudinal gap large enough for ingress and egress of the person to and from the inner space; and a flexible water hose connected to a sprayer and attached to the collapsible enclosure, the hose being incorporated into the enclosure so that it collapses and expands with the enclosure, wherein the hose is held within pockets sewn into the liner, and the hose extends partly in alignment with individual struts and partly along vertical shortcuts between struts to avoid sharp bends.

9. The portable shower of claim 8, wherein a total weight of the portable shower is between 4-7 lbs, and further including a flat circular carrying bag into which the collapsible enclosure can be fitted in its longitudinally flat configuration.

10. The portable shower of claim 8, wherein the liner opening includes a closure selected from the group consisting of a zipper, flaps with mating hook and loop fasteners, buttons, and ties.

11. The portable shower of claim 8, wherein the junctions are V-shaped and spring loaded to assist in expanding the enclosure to its extended configuration.

12. The portable shower of claim 8, wherein the junctions are V-shaped and have locks to enable the junctions to be locked into several angular orientations including an expanded V-shape.

13. A portable shower, comprising:

a collapsible enclosure having a flexible liner and a skeleton of elastic material secured to the liner, the skeleton being secured around the liner so that, when permitted to elongate longitudinally, the skeleton supports the enclosure in a three-dimensional extended configuration with the liner surrounding an inner space large enough for a person to stand in, and wherein the skeleton is configured to be compressed longitudinally to collapse the enclosure down to a longitudinally flat configuration for transport, the skeleton of elastic material being formed by a series of struts each extending between 270-315° around the inner space and having junctions defining a discontinuity around a circumference of the skeleton so as to form a longitudinal gap on one side of the skeleton extending between an upper circular ring and a lower circular ring, each junction being convertible between the longitudinally flat configuration of the enclosure and the three-dimensional extended configuration of the enclosure wherein adjacent struts form a V-shaped angle with respect to each other, and the liner has a longitudinal opening aligned with the longitudinal gap large enough for ingress and egress of the person to and from the inner space; and a flexible water hose connected to a sprayer and attached to the collapsible enclosure, the hose being incorporated into the enclosure so that it collapses and expands with the enclosure.

14. The portable shower of claim 13, wherein a total weight of the portable shower is between 4-7 lbs, and further including a flat circular carrying bag into which the collapsible enclosure can be fitted in its generally two-dimensional configuration.

15. The portable shower of claim 13, wherein the hose is held within pockets sewn into the liner, and the hose extends partly in alignment with individual struts and partly along vertical shortcuts between struts to avoid sharp bends.

16. The portable shower of claim 13, wherein the liner opening includes a closure selected from the group consisting of a zipper, flaps with mating hook and loop fasteners, buttons, and ties.

17. The portable shower of claim 13, wherein the junctions are spring loaded to assist in expanding the enclosure to its extended configuration.

18. The portable shower of claim 13, wherein the junctions have locks to enable them to be locked into at least the three-dimensional extended configuration of the skeleton.

19. A portable shower, comprising:

a collapsible enclosure having a flexible liner and a skeleton of elastic material secured to the liner, the skeleton being secured around the liner so that, when permitted to elongate longitudinally, the skeleton supports the enclosure in a three-dimensional extended configuration with the liner surrounding an inner space large enough for a person to stand in, and wherein the skeleton is configured to be compressed longitudinally to collapse the enclosure down to a longitudinally flat configuration for transport, the skeleton of elastic material being formed by a series of struts surrounding the inner space wherein adjacent struts form a V-shaped angle with respect to each other when in an extended configuration and are each connected by a junction, the junctions defining a discontinuity around a circumference of the skeleton so as to form a longitudinal gap on one side of the skeleton extending between an upper circular ring and a lower circular ring space, wherein the junctions are V-shaped and have locks to enable the junctions to be locked into several angular orientations including an expanded V-shape, and the liner has a longitudinal opening aligned with the longitudinal gap large enough for ingress and egress of the person to and from the inner; and a flexible water hose connected to a sprayer and attached to the collapsible enclosure, the hose being incorporated into the enclosure so that it collapses and expands with the enclosure.

20. The portable shower of claim 19, wherein the liner opening includes a closure selected from the group consisting of a zipper, flaps with mating hook and loop fasteners, buttons, and ties.

21. The portable shower of claim 19, wherein a total weight of the portable shower is between 4-7 lbs, and further including a flat circular carrying bag into which the collapsible enclosure can be fitted in its longitudinally flat configuration.

22. The portable shower of claim 19, wherein the hose is held within pockets sewn into the liner.

* * * * *